US007382086B2

(12) United States Patent
Yamagishi

(10) Patent No.: US 7,382,086 B2
(45) Date of Patent: Jun. 3, 2008

(54) INDIRECTLY HEATED CATHODE AND CATHODE RAY TUBE HAVING SAME

(75) Inventor: Mika Yamagishi, San Diego, CA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 144 days.

(21) Appl. No.: 10/546,562

(22) PCT Filed: Mar. 15, 2004

(86) PCT No.: PCT/JP2004/003388

§ 371 (c)(1),
(2), (4) Date: Aug. 22, 2005

(87) PCT Pub. No.: WO2004/081962

PCT Pub. Date: Sep. 23, 2004

(65) Prior Publication Data

US 2006/0145586 A1 Jul. 6, 2006

(30) Foreign Application Priority Data

Mar. 14, 2003 (JP) ..... 2003-070016

(51) Int. Cl.
*H01J 1/24* (2006.01)

(52) U.S. Cl. ..... 313/346 R; 313/340; 313/326

(58) Field of Classification Search ..... 313/346
See application file for complete search history.

(56) References Cited

U.S. PATENT DOCUMENTS 2,566,115 A * 8/1951 Bounds ..... 420/460
2,809,890 A * 10/1957 Bounds ..... 420/457
2,830,917 A * 4/1958 Kern ..... 428/632
3,662,211 A * 5/1972 Millis ..... 313/340
6,791,251 B2 * 9/2004 Seo et al. ..... 313/337
2002/0074921 A1 * 6/2002 Gaertner et al. ..... 313/346 R
2003/0173886 A1 9/2003 Yamagishi et al.

FOREIGN PATENT DOCUMENTS

JP 58-025034 2/1983
JP 59-149622 8/1984
JP 03155026 * 7/1991
JP 9-102266 4/1997
JP 11/273618 10/1999
JP 2003-007193 1/2003

* cited by examiner

*Primary Examiner*—Anabel M Ton

(57) ABSTRACT

An indirectly heated cathode includes a cathode sleeve (2) housing a heater (1), a caplike base (3) attached onto the cathode sleeve (2), and an electron emitter layer (4) formed on a surface of the base (3). The cathode sleeve (2) is made of a metal material that contains nickel and chromium as main components and further contains at least silicon, aluminum, cerium, and lanthanum. According to this construction, the cathode sleeve (2) is kept from heat deformation. Hence a reliable indirectly heated cathode which suppresses variations in cutoff voltage can be realized.

6 Claims, 7 Drawing Sheets

INDIRECTLY HEATED CATHODE AND CATHODE RAY TUBE HAVING SAME

TECHNICAL FIELD

The present invention relates to an indirectly heated cathode having a cathode sleeve, and to a cathode ray tube which includes the indirectly heated cathode.

BACKGROUND ART

An indirectly heated cathode, such as an indirectly heated cathode 100 shown in FIG. 7, is conventionally used as a cathode of an electron gun which is housed in a neck of a cathode ray tube.

As shown in the drawing, the indirectly heated cathode 100 includes a cylindrical cathode sleeve 102 enclosing a spiral heater 101, a caplike base 103 provided on the cathode sleeve 102, and an electron emitter layer 104 formed by coating an upper surface of the base 103 with an electron emitting material such as an alkaline earth metal using a spray or the like.

The cathode sleeve 102 is placed in a cylindrical cathode holder 105, and held by the cathode holder 105 via cathode supporters 106.

The cathode sleeve 102 has a function of transmitting heat generated from the heater 101 to the electron emitter layer 104. The cathode sleeve 102 is made of a material that contains nickel (Ni) and chromium (Cr) as main components.

When a cathode ray tube having this conventional indirectly heated cathode 100 is used for a longtime, however, the cathode sleeve 102 is significantly deformed by the heat generated from the heater 101. In particular, if the cathode sleeve 102 expands or contracts in the direction A shown in FIG. 7 and as a result its overall length changes, a distance between the base 103 and electrodes in the electron gun such as a control electrode changes, which causes a cutoff voltage to vary.

In cathode ray tubes, the cutoff voltage is an important parameter for setting the amount of electron beam emission. If the cutoff voltage varies, a proper image display cannot be achieved. Especially in the case of color cathode ray tubes that use three cathodes for R, G, and B, a color balance of a display image is greatly disturbed if the cutoff voltage in each cathode changes, which makes it impossible to properly display the image.

In view of this problem, an indirectly heated cathode in which a metal material of a cathode sleeve is formed into two or more layers of crystal structure is proposed in order to increase a resistance to heat deformation and thereby suppress variations in cutoff voltage (e.g. Japanese Patent Application Publication No. H09-102266).

This type of indirectly heated cathode, however, requires a complex manufacturing process since the crystal structure needs to be formed by repeating annealing and rolling. Besides, indirectly heated cathodes produced in separate furnaces may differ from each other. Furthermore, a sufficient resistance to heat deformation cannot be attained.

The present invention was conceived to solve the above problems, and aims to provide a reliable indirectly heated cathode that is easy to manufacture, suppresses variations in cutoff voltage by keeping a cathode sleeve from heat deformation caused by a long operation of a cathode ray tube, and exhibits little dispersion between products. The present invention also aims to provide a cathode ray tube having such an indirectly heated cathode.

DISCLOSURE OF INVENTION

The stated aim can be achieved by an indirectly heated cathode including: a tubular cathode sleeve; a heater inserted in the cathode sleeve; a base attached to one open end of the cathode sleeve; and an electron emitter layer formed on an opposite surface of the base to the heater, wherein the cathode sleeve is made of a metal material that contains nickel and chromium as main components and further contains at least silicon, aluminum, cerium, and lanthanum.

According to this construction, the heat deformation of the cathode sleeve is minimized, with it being possible to suppress variations in cutoff voltage. Hence a proper image display can be achieved with a cathode ray tube having this indirectly heated cathode. This indirectly heated cathode can be produced just by modifying the additives of the metal material of a conventional cathode sleeve, with there being no need to perform a complex manufacturing step of forming a crystal structure through repeated annealing and rolling. Thus, the manufacturing can be performed easily, without causing inconsistencies between products.

Here, when XSi denotes a content of silicon in the metal material by wt %, XAl denotes a content of aluminum in the metal material by wt %, XCe denotes a content of cerium in the metal material by wt %, and XLa denotes a content of lanthanum in the metal material by wt %, XSi, XAl, XCe, and XLa are preferably $$0.110 \leqq XSi \leqq 0.230$$

$$0.004 \leqq XAl \leqq 0.012$$

$$0.005 \leqq XCe \leqq 0.012$$

$$0 < XLa \leqq 0.020$$

According to this construction, the heat deformation of the cathode sleeve can be suppressed more effectively.

A cathode ray tube having the indirectly heated cathode of the above construction has little variations in cutoff voltage even when operated for a long time, with it being possible to maintain a favorable image display.

BEST MODE FOR CARRYING OUT THE INVENTION

The following describes an indirectly heated cathode and a cathode ray tube to which an embodiment of the present invention relates, with reference to FIGS. 1 to 4.

Figure 3:
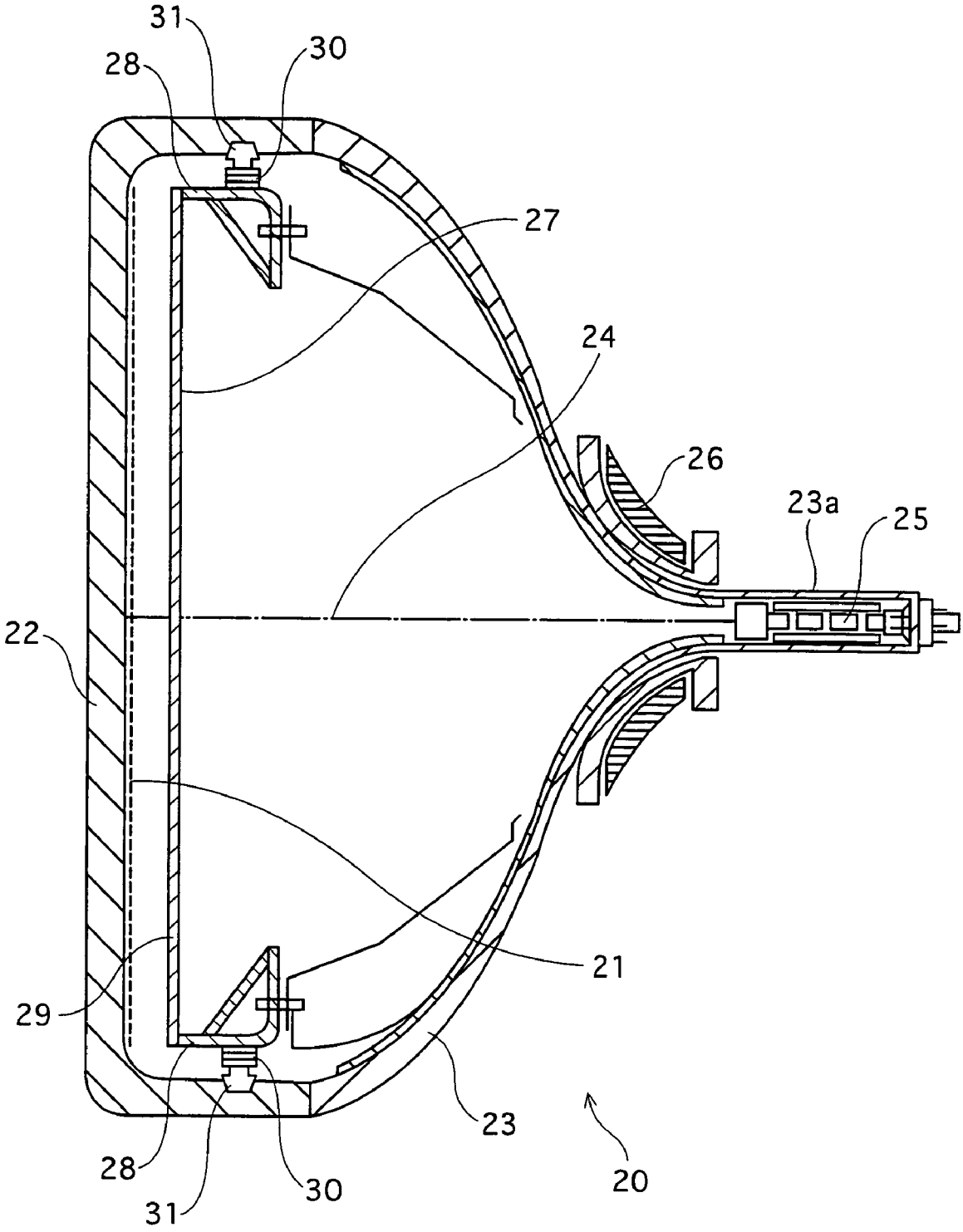
FIG. 3 is a schematic sectional view of a cathode ray tube to which the embodiment of the present invention relates.

FIG. 3 is a schematic sectional view showing a construction of a cathode ray tube 20 in the embodiment of the present invention.

As illustrated, the cathode ray tube 20 has a glass panel 22 with a phosphor screen 21 formed on its inner surface, and a glass funnel 23 connected behind the panel 22. The panel 22 and the funnel 23 constitute an envelope. An electron gun 25 for emitting electron beams 24 is housed in a neck 23*a* of the funnel 23.

Also, a deflection yoke 26 for deflecting the electron beams 24 emitted from the electron gun 25 is attached to an outer surface of the funnel 23. Meanwhile, the inner surface of the panel 22 is coated with phosphor dots of three colors, to form the phosphor screen 21. A flat color-selection electrode 27 is arranged substantially in parallel with this phosphor screen 21.

The color-selection electrode 27 has a large number of regularly arranged apertures that are formed by etching a flat plate. The color-selection electrode 27 has a function of color selection for the three electron beams 24 emitted from the electron gun 25. The color-selection electrode 27 is held by a frame 28 to constitute a color-selection electrode structure 29.

The color-selection electrode structure 29 is engaged with the envelope by fitting together an elastic supporter 30 attached to the frame 28 and a panel pin 31 implanted in the panel 22.

Figure 4:
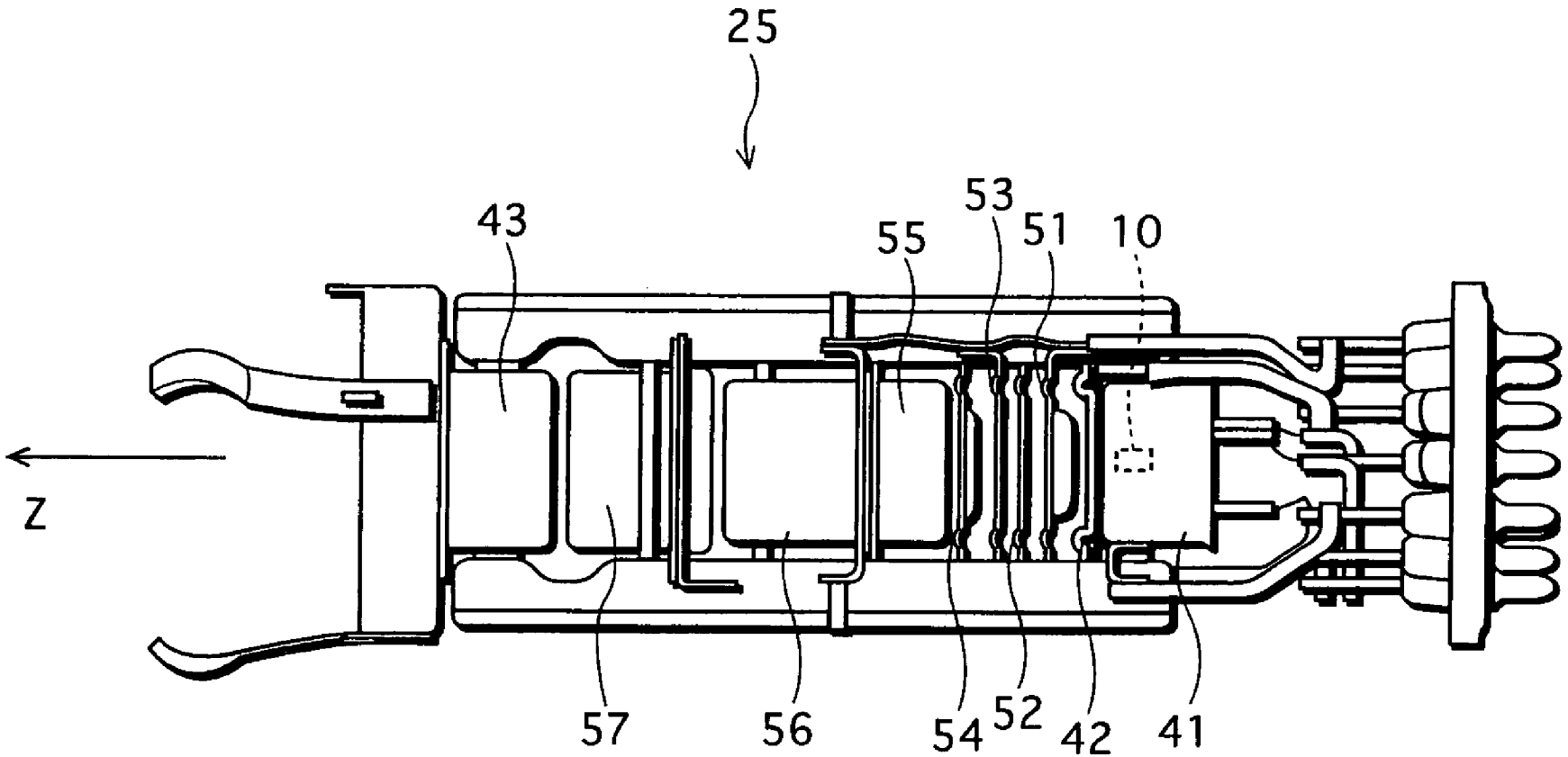
FIG. 4 shows a construction of an electron gun including the indirectly heated cathode shown in FIG. 1.

FIG. 4 shows an example construction of the electron gun 25.

As illustrated, the electron gun 25 is oriented so as to extend in a direction of a tube axis (Z axis) of the cathode ray tube. From the right side of the drawing to the left side that is the phosphor screen 21 side (see FIG. 3), the electron gun 25 has a tubular control electrode 41 with a closed bottom, an accelerating electrode 42, focusing electrodes 51 to 57, and a final accelerating electrode 43 in this order.

In the control electrode 41, three indirectly heated cathodes 10 corresponding to R (red), G (green), and B (blue) are aligned on a horizontal axis orthogonal to the tube axis. Also, three beam passage holes corresponding to these indirectly heated cathodes 10 are formed at the bottom of the control electrode 41. The indirectly heated cathodes 10, one each for the three colors, have the same construction.

Electrons emitted from the indirectly heated cathodes 10 are focused by a cathode lens that is generated by the control electrode 41 and the accelerating electrode 42, thereby forming a crossover. The electrons further travel to be focused by a prefocus lens and a main focus lens that are generated by the accelerating electrode 42, the focusing electrodes 51 to 57, and the final accelerating electrode 43, and eventually converge on the phosphor screen 21.

Figure 1:
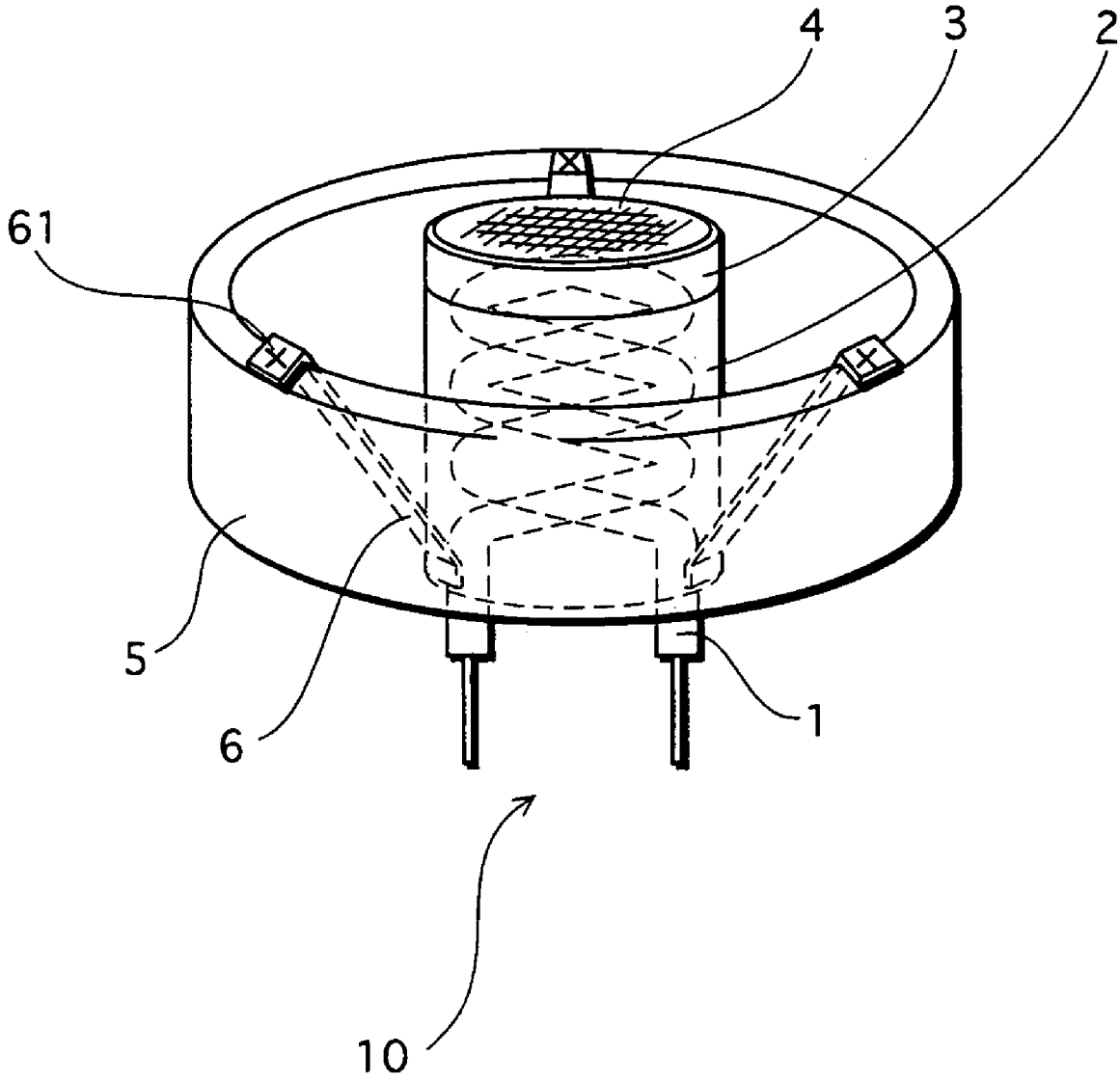
FIG. 1 is a perspective view of an indirectly heated cathode to which an embodiment of the present invention relates.
Figure 2:
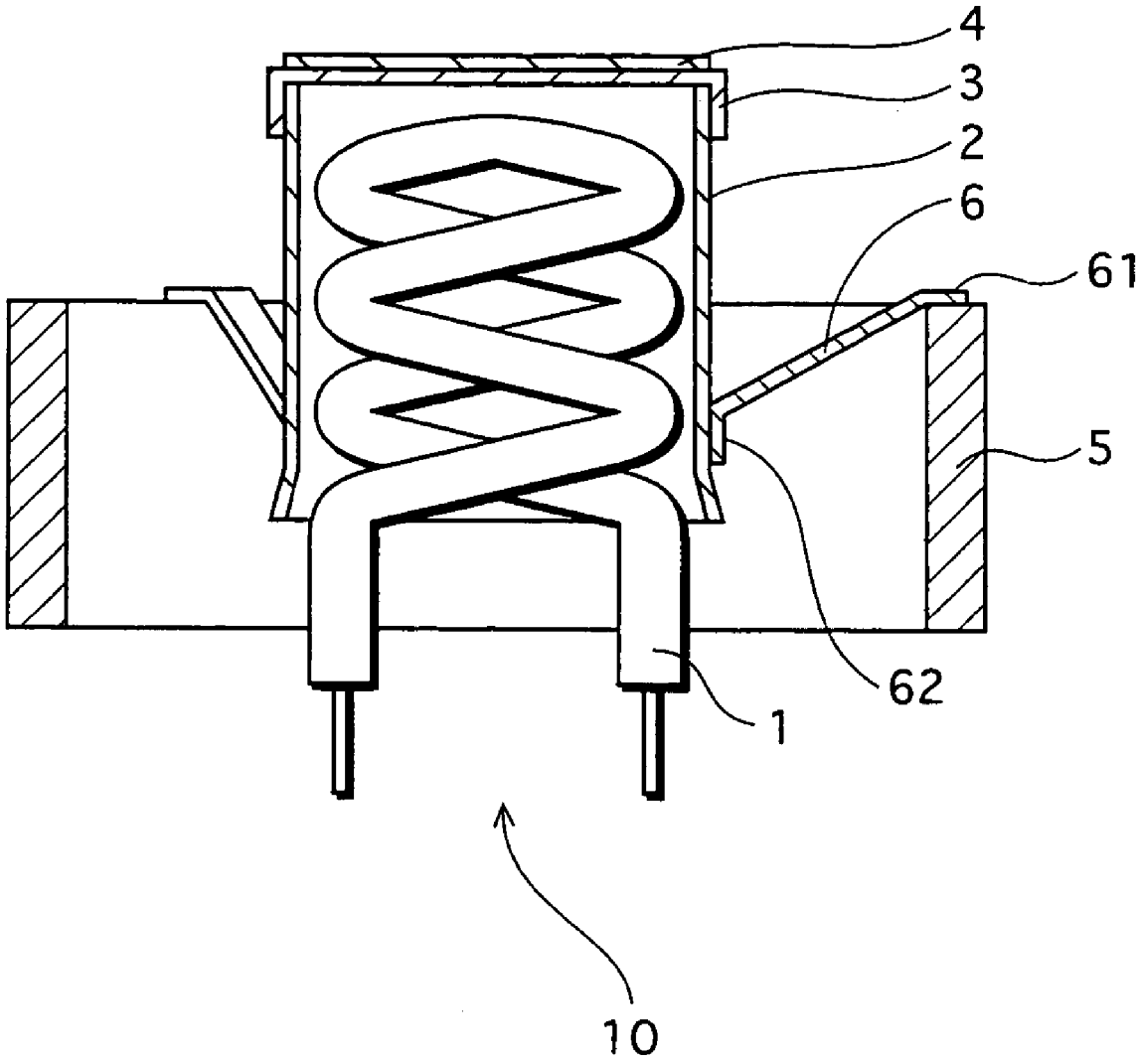
FIG. 2 is a sectional view of a relevant part of the indirectly heated cathode shown in FIG. 1.

FIG. 1 is a perspective view of the indirectly heated cathode 10 according to this embodiment. FIG. 2 is a sectional view of the indirectly heated cathode 10.

As shown in these drawings, the indirectly heated cathode 10 according to this embodiment includes a heater 1 coated with an insulator on its surface, a cylindrical cathode sleeve 2 housing the heater 1, a caplike base 3 provided on the cathode sleeve 2, and an electron emitter layer 4 formed by coating an upper surface of the base 3 with an electron emitting material such as an alkaline earth metal using a spray or the like.

The cathode sleeve 2 is held by a cylindrical cathode holder 5 via three cathode supporters 6, in a state of being surrounded by the cathode holder 5. The cathode holder 5 and the heater 1 are positioned, through a frame (not illustrated), such that the heater 1 and the cathode sleeve 2 have a positional relationship shown in FIG. 2.

The cathode supporters 6 are connected to an upper edge of the cathode holder 5 and a side surface of the cathode sleeve 2 at their connecting parts 61 and 62, by resistance welding or the like.

The cathode sleeve 2 is made by processing a metal material that is mainly composed of nickel (Ni) and chromium (Cr). This metal material contains at least silicon (Si), aluminum (Al), cerium (Ce), and lanthanum (La) as additives. Also, a black coating of chromic oxide is formed on the surface of the cathode sleeve 2, to improve the efficiency of absorbing heat generated from the heater 1.

The indirectly heated cathode 10 is equipped in the electron gun 25 shown in FIG. 4. Heat generated from the heater 1 by applying a predetermined voltage to the heater 1 is transmitted to the electron emitter layer 4 via the cathode sleeve 2, as a result of which an electron beam is emitted.

By forming the cathode sleeve 2 with the metal material that is mainly composed of Ni and Cr and at least contains predetermined amounts of Si, Al, Ce, and La as additives in the above way, the heat deformation of the cathode sleeve 2 can be significantly reduced.

This effect is explained using specific examples below.

EXAMPLE 1

An accelerated life test was conducted on a 32-inch cathode ray tube having an electron gun in which three indirectly heated cathodes 10 of the embodiment are arranged in-line.

Here, the cathode sleeve 2 is a cylinder with a diameter of 1.57 mm, a height of 2.5 mm, and a thickness of 0.05 mm. A material of the cathode sleeve 2 is an Ni—Cr alloy containing Si (0.18 wt %), Al (0.008 wt %), Ce (0.009 wt %), and La (0.02 wt %). Also, a black coating of chromic oxide is formed on the surface of the cathode sleeve 2.

The same test was conducted on a cathode ray tube having a conventional indirectly heated cathode that does not contain Ce and La, as a comparative example.

Figure 5:
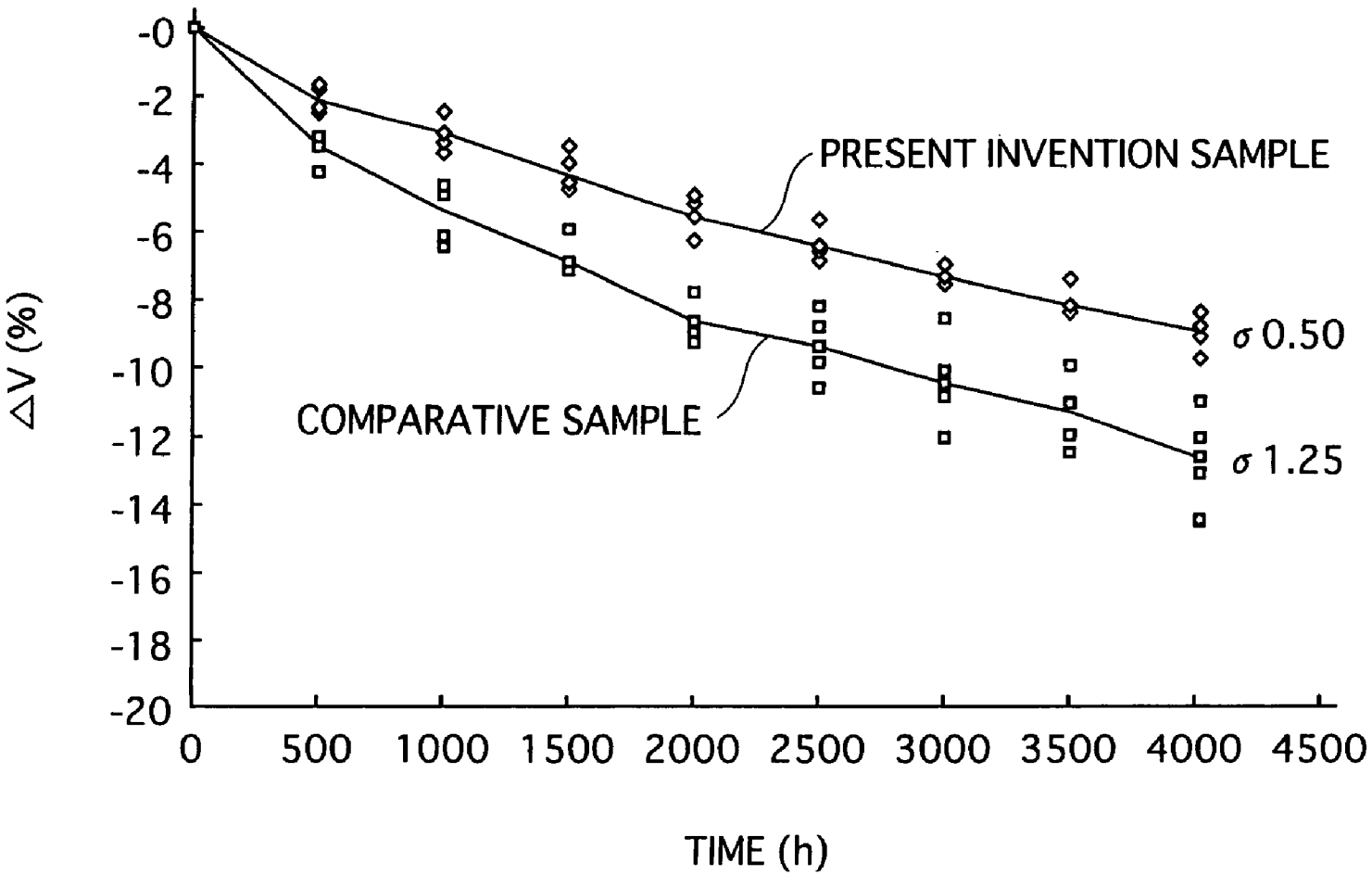
FIG. 5 shows variations in cutoff voltage for each of a cathode ray tube having the indirectly heated cathode according to the embodiment and a cathode ray tube according to a comparative example.

FIG. 5 shows variations ($\Delta V$) in cutoff voltage relative to elapsed times, when operating the cathode ray tube for a predetermined time period. The horizontal axis represents an operation time of the cathode ray tube, whereas the vertical axis represents a variation in cutoff voltage by %.

The above test was conducted on each of five cathode ray tubes (a present invention sample) which use the indirectly heated cathode according to the present invention, and each of five cathode ray tubes (a comparative sample) which use the indirectly heated cathode according to the comparative example. In a line graph shown in FIG. 5, average cutoff voltage variations at respective elapsed times are linked by straight lines, for each of the present invention sample and the comparative sample.

After 3000 hours, for instance, the cutoff voltage of the comparative sample varied by about −10%, whereas the cutoff voltage of the present invention sample varied by only about −7%, as shown in FIG. 5. Thus, the variation in cutoff voltage was reduced by about 3%, when compared with the comparative sample.

The present invention sample exhibited more favorable results than the comparative sample in terms of dispersion in cutoff voltage variation between cathode ray tubes, too. After 4000 hours, for instance, the standard deviation σ of the cutoff voltage variations of the comparative sample was 1.25, whereas the standard deviation a of the cutoff voltage variations of the present invention sample was 0.50. Thus, the dispersion in cutoff voltage variation was greatly reduced when compared with the comparative sample.

The inventor of the present invention investigated into the cause of the above test results and reached the following conclusion. If the cathode sleeve does not contain any of Ce and La as in the conventional art, an excessive black coating develops, which increases the heat deformation of the cathode sleeve during its life.

By adding Ce and La to the conventional cathode sleeve material that is an Ni—Cr alloy containing Si and Al as additives as in the embodiment, such excessive black coating formation is suppressed. Hence indirectly heated cathodes that are more resistant to heat deformation and exhibit less dispersion in heat deformation can be obtained.

The above test was also conducted on a cathode ray tube having an indirectly heated cathode in which a conventional cathode sleeve is formed as two or more layers of crystal structure. In this case, the variation of the cutoff voltage was about −10.8%, and the standard deviation σ of the variation was about 1.88. When compared with this too, the present invention sample demonstrated significant reductions in variation of the cutoff voltage and its dispersion.

EXAMPLE 2

Figure 6A:
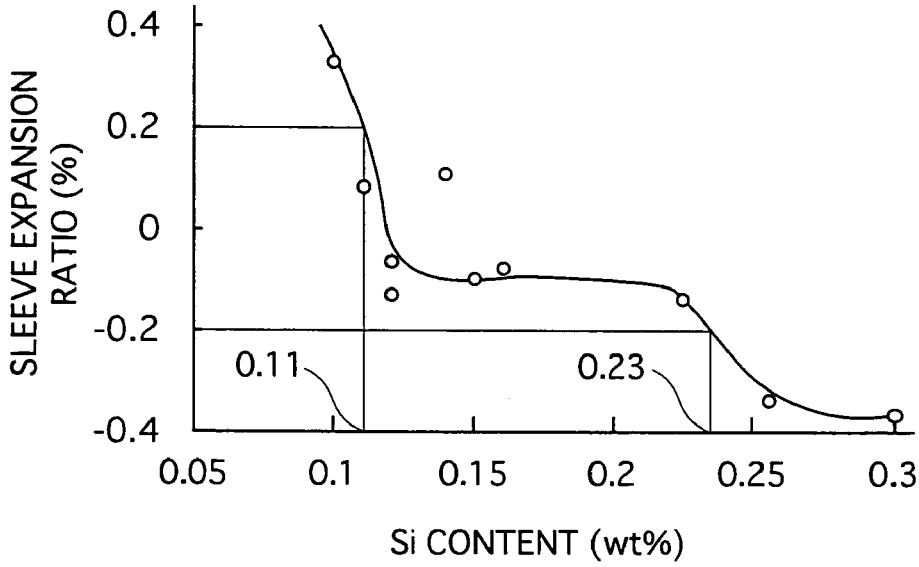
FIG. 6A shows a relationship between an Si content of a cathode sleeve in the indirectly heated cathode according to the embodiment and an expansion ratio of the cathode sleeve.
Figure 6B:
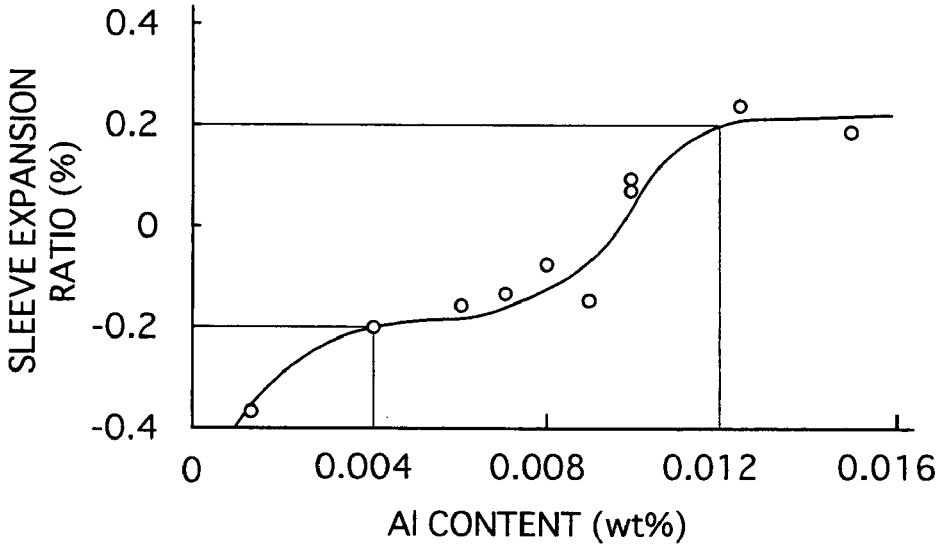
FIG. 6B shows a relationship between an Al content of the cathode sleeve in the indirectly heated cathode according to the embodiment and the expansion ratio of the cathode sleeve.
Figure 6C:
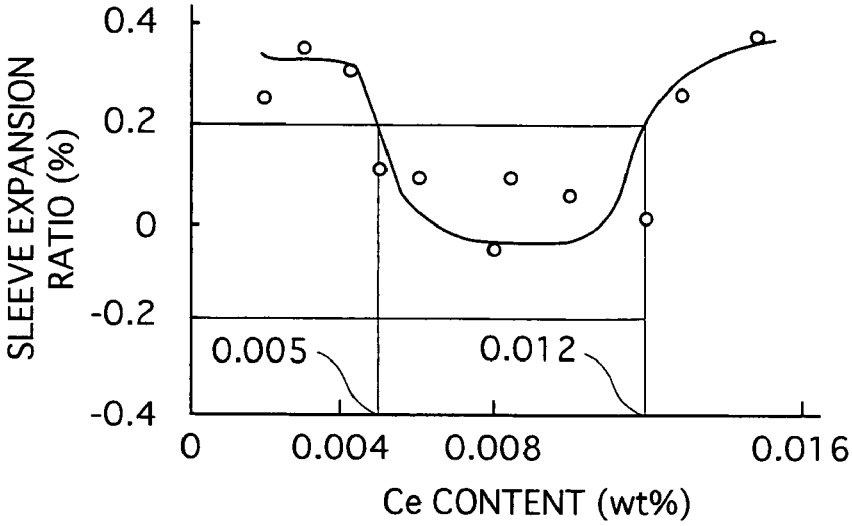
FIG. 6C shows a relationship between a Ce content of the cathode sleeve in the indirectly heated cathode according to the embodiment and the expansion ratio of the cathode sleeve.

Experiments were conducted about a relationship between a content of each additive (impurity) in the cathode sleeve of the indirectly heated cathode according to the embodiment and an expansion ratio of the cathode sleeve after heat treatment, in order to determine an optimal range of the content of each additive. FIGS. 6A, 6B, and 6C show results of these experiments.

Figure 7:
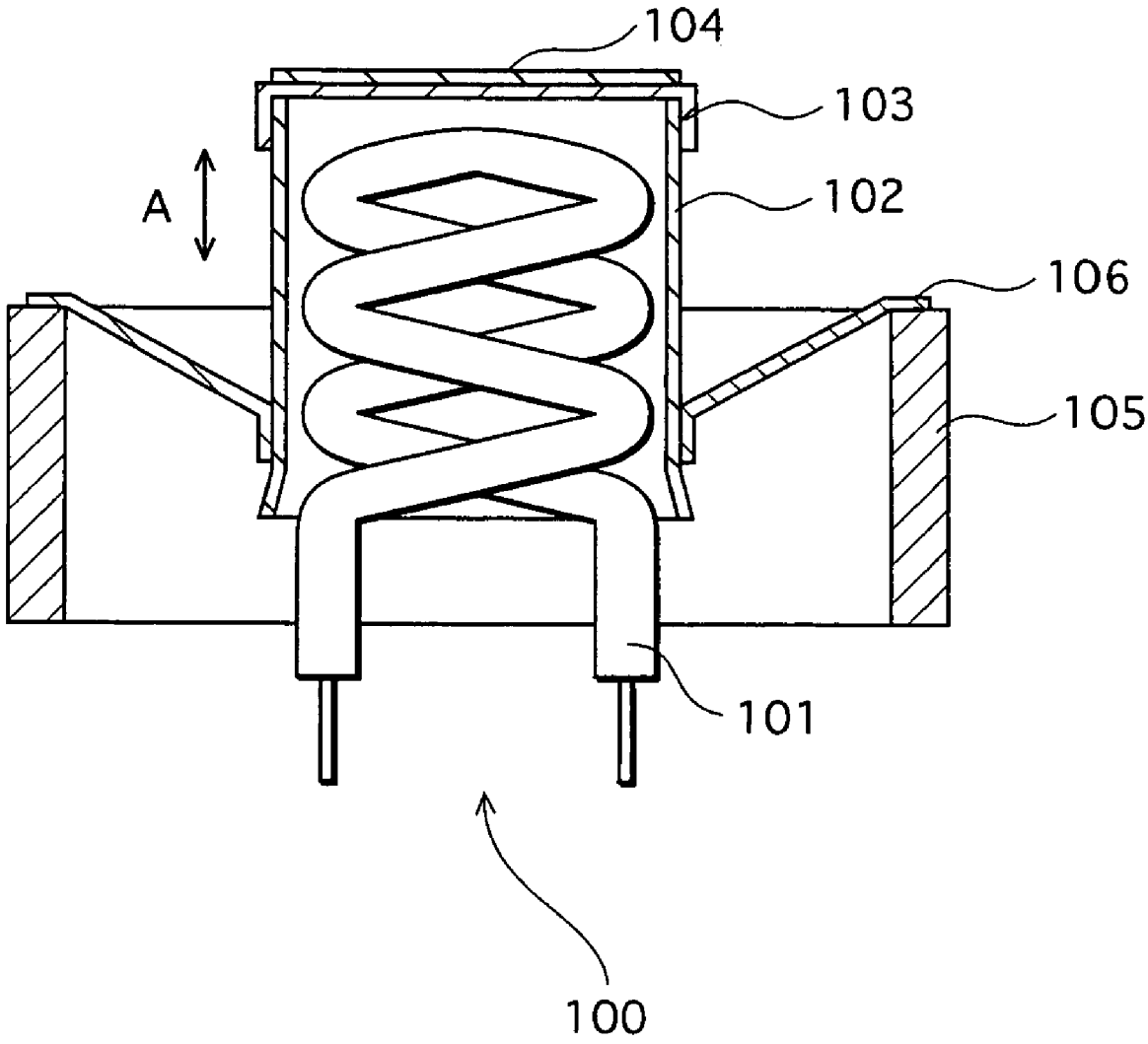
FIG. 7 is a sectional view of a relevant part of a conventional indirectly heated cathode.

FIGS. 6A, 6B, and 6C respectively show expansion ratios of the cathode sleeve relative to contents of Si, Al, and Ce in the Ni—Cr alloy. The horizontal axis represents a content of a corresponding metal (wt %), whereas the vertical axis represents an expansion ratio of the cathode sleeve in the direction A (see FIG. 7) by %.

In this example too, an accelerated life test was conducted on a 32-inch cathode ray tube having an electron gun with three indirectly heated cathodes arranged in-line. Each of these indirectly heated cathodes includes a cathode sleeve that is of the same size as the above example 1 with a black coating of chromic oxide formed on its surface. The expansion ratio of the cathode sleeve was measured when a time equivalent to 3000 hours of normal operation had passed. A temperature of the cathode sleeve at this point was about 800° C.

In each experiment, the contents of Si, Al, and Ce were changed respectively in the ranges of 0.1 to 0.3 wt %, 0 to 0.016 wt %, and 0 to 0.016 wt %. Also, the contents of additives other than an additive which is changed in content were fixed at 0.18 wt % for Si, 0.008 wt % for Al, 0.009 wt % for Ce, and 0.02 wt % for La.

In a typical cathode ray tube, a range of variation in cutoff voltage that will not disturb a color balance of an image display is generally ±8%. A tolerance of an expansion ratio of a cathode sleeve to this variation range is ±0.2%.

Let $X_{Si}$ (wt %) be the content of Si, $X_{Al}$ (wt %) be the content of Al, and $X_{Ce}$ (wt %) be the content of Ce, in FIGS. 6A to 6C. Considering the above tolerance of the expansion ratio of the cathode sleeve, $X_{Si}$, $X_{Al}$, and $X_{Ce}$ are preferably $0.110 \leqq X_{Si} \leqq 0.230$, $0.004 \leqq X_{Al} \leqq 0.012$, and $0.005 \leqq X_{Ce} \leqq 0.012$, respectively.

The inventor of the present invention also conducted an experiment on the content $X_{La}$ (wt %) of La, and learned that the expansion ratio of the cathode sleeve exceeded ±0.2% when $X_{La}$ was over 0.020. Therefore, $X_{La}$ is preferably $0 < X_{La} \leqq 0.020$. The contents of the other additives in this experiment were 0.18 wt % for Si, 0.008 wt % for Al, and 0.009 wt % for Ce.

By limiting the contents of Si, Al, Ce, and La to the above ranges, a cathode sleeve that is more resistant to heat deformation can be obtained, with it being possible to produce an indirectly heated cathode having little variations in cutoff voltage.

A cathode ray tube equipped with such a cathode experiences little variations in cutoff voltage even when operated for a long time, and can therefore produce a stable image display. Also, the dispersion in cutoff voltage variation between products is small, which enables a color cathode ray tube to maintain a favorable RGB color balance.

INDUSTRIAL APPLICABILITY

A cathode ray tube having an indirectly heated cathode according to the present invention has little variations in cutoff voltage even when operated for a long time. Also, the dispersion in cutoff voltage variation between products is small. Hence the cathode ray tube is suited to producing a stable image display.

The invention claimed is:

1. An indirectly heated cathode comprising:

a tubular cathode sleeve;

a heater inserted in the cathode sleeve;

a base attached to one open end of the cathode sleeve; and an electron emitter layer formed on an opposite surface of the base to the heater, wherein the cathode sleeve is made of a metal material that contains nickel and chromium as main components and further contains silicon, aluminum, cerium, and lanthanum.

2. The indirectly heated cathode of claim 1, wherein $$0.110 \leqq XSi \leqq 0.230$$

$$0.004 \leqq XAl \leqq 0.012$$

$$0.005 \leqq XCe \leqq 0.012$$

$$0 < XLa \leqq 0.020$$

where XSi denotes a content of silicon in the metal material by wt %, XAl denotes a content of aluminum in the metal material by wt %, XCe denotes a content of cerium_in the metal material by wt %, and XLa denotes a content of lanthanum in the metal material by wt %.

3. The indirectly heated cathode of claim 1, wherein the cathode sleeve is coated with chromic oxide.

4. A cathode ray tube comprising the indirectly heated cathode of claim 1.

5. A cathode ray tube comprising the indirectly heated cathode of claim 2.

6. A cathode ray tube comprising the indirectly heated cathode of claim 3.

* * * * *